US005498300A

United States Patent [19]

Aoki et al.

[11] Patent Number: 5,498,300

[45] Date of Patent: Mar. 12, 1996

[54] COMPOSITION AND PROCESS FOR TREATING TINPLATE

[75] Inventors: Tomoyuki Aoki; Masayuki Yoshida, both of Kanagawa, Japan

[73] Assignee: Henkel Corporation, Plymouth Meeting, Pa.

[21] Appl. No.: 454,205

[22] PCT Filed: Dec. 1, 1993

[86] PCT No.: PCT/US93/11435

§ 371 Date: Jun. 9, 1995

§ 102(e) Date: Jun. 9, 1995

[87] PCT Pub. No.: WO94/13855

PCT Pub. Date: Jun. 23, 1994

[30] Foreign Application Priority Data

Dec. 9, 1992 [JP] Japan ..... 4-351518

[51] Int. Cl.[6] ..... C23C 22/10; C23C 22/23

[52] U.S. Cl. ..... 148/261

[58] Field of Search ..... 148/261

[56] References Cited

U.S. PATENT DOCUMENTS 4,927,472 5/1990 Matsushima ..... 148/261

*Primary Examiner*—Sam Silverberg

*Attorney, Agent, or Firm*—Ernest G. Szoke; Wayne C. Jaeschke; Norvell E. Wisdom, Jr.

[57] ABSTRACT

To impart an excellent corrosion resistance and adherence to the surface of tinplate while avoiding the production of sludge in the treatment bath during continuous treatment, a bath is used that contains phosphate ions, from 0.1 to 5.0 g/L of chelating agent, and tin ions; has a pH from 2.0 to 4.5; is essentially free of oxidizing agent and ferric ion; and has an oxidation-reduction potential of ≦450 mV more oxidizing than a silver-saturated silver chloride reference electrode.

20 Claims, No Drawings

COMPOSITION AND PROCESS FOR TREATING TINPLATE

TECHNICAL FIELD

The invention relates to a phosphate containing composition (often denoted hereinafter as a "bath" for brevity) for treating the surface of tinplate (i.e,, tin-plated steel) and to a treatment process for tinplate. More specifically, the present invention relates to an improvement of a treatment that is already used, prior to the painting or printing of surfaces of tinplate sheet, strip, and formed objects, e.g., cans and the like, to provide such surfaces with an excellent corrosion resistance and paint adherence. In particular, the treatment bath and treatment process of the present invention are well adapted for treating surfaces of tinplate that has been formed by DI (i.e., drawing-and-ironing) processing. Thus, the present invention concerns a novel technology for treating tinplate surfaces, a technology that may be used to provide tinplate surfaces with an excellent corrosion resistance and paint adherence, but which is free or very nearly free of the insoluble salts (hereinafter referred to as "sludge") that are produced by the tin ions and iron ions that elute into the bath during treatment. This sludge reduces the productivity of tinplate surface treatment lines.

BACKGROUND ART

The cleaning and surface treatment of tinplate is frequently conducted by a spray process. For example, the surface treatment equipment for tinplate DI can is generally called a washer. Molded DI can is inverted and continuously treated in the washer with a cleaning bath and a surface treatment bath. Existing washers normally use 6 steps (precleaning, cleaning, water wash, surface treatment, water wash, and wash with de-ionized water), and treatment is conducted entirely by spraying.

Compositions of phosphate ion, tin ion, and oxidizing agent are already known as surface treatment baths for tinplate DI can. As discussed by the present inventors in *Nihon Parkerizing Giho,* 89, No. 2, page 6, the mechanism of conversion film formation by these components consists of tin and iron elution reactions (anodic reactions) and the precipitation of insoluble phosphate salts (cathodic reaction).

Furthermore, in Japanese Patent Application Laid Open [Kokai or Unexamined] Number Hei 1-100281 [100,281/1989]), there has already been proposed a composition for the purpose of inverting the tin-iron potential in the conversion bath, i.e., the tin region becomes the anode and the iron region becomes the cathode. This particular invention consists of a conversion coating bath for the treatment of metal surfaces. This bath has a pH of 2 to 6 and contains 1 to 50 grams per liter (hereinafter often abbreviated "g/L") of phosphate ions, 0.2 to 20.0 g/L of oxyacid ions, 0.01 to 2.0 g/L of tin ion, and 0.01 to 5.0 g/L of condensed phosphate ions. Treatment with this conversion treatment bath forms a highly corrosion-resistant, highly paint-adherent phosphate film on the surface of tinplate DI can. The oxyacid ion is an oxidizing agent that functions to oxidatively remove the hydrogen that is produced by the anodic reactions.

When the aforesaid invention is practiced on a continuous basis, it is in fact capable of initially providing an excellent surface treatment. However, it has been found that the referenced invention gradually generates a phosphate salt sludge, which is produced by the reaction of the phosphate ions present in the bath with the tin ions and iron ions that elute from the tinplate. It has also been determined that iron ions elute from the tinplate in the divalent state; that gradual oxidation by the oxidizing agent (oxyacid ion, etc.) produces the trivalent state in the surface treatment bath at a level of approximately 0.05 g/L; and that this is the cause of sludge production.

This sludge can cause problems by adhering to the tinplate surface and degrading the paint adherence. In addition, the sludge can clog the piping and nozzles of the spray equipment and can thereby prevent a high quality surface treatment. This has necessitated the implementation of periodic maintenance in order to clean the piping and nozzles of the spray equipment and has resulted in unstable quality characteristics. Since productivity enhancements and improvements in quality stability have recently become critical issues, a surface treatment bath is desired that carries a reduced cleaning burden and that offers stable quality characteristics, i.e., that is free of sludge production in the bath even during continuous service.

DISCLOSURE OF THE INVENTION

Problem(s) to Be Solved by the Invention

Accordingly, the present invention takes as its object the introduction of a bath and process for treating tinplate surfaces that solves the problems described above and that enhances quality stability and leads to improvements in productivity (easy maintenance and the like).

SUMMARY OF THE INVENTION

As a result of extensive research into the problems described above, it was determined that sludge production is particularly significantly influenced by the oxidation state (divalent or trivalent) in the treatment composition of the iron ions present therein, which normally elute from the tinplate during treatment with the composition. With respect to a bath for treating tinplate surfaces that comprises, preferably consists essentially of, or more preferably consists of, water, acidity, phosphate ions, chelating agent, and tin ions, it was also determined that an excellent corrosion resistance and paint adherence could be obtained without sludge production—even during continuous treatment—by such a bath for treating tinplate surfaces that has a pH in the range of 2.0 to 4.5 and a concentration of chelating agent in the range of 0.1 to 5.0 g/L and that essentially does not contain ferric iron or an oxidizing agent sufficiently strong to oxidize ferrous to ferric ions. The present invention was achieved based on these findings.

In addition, the iron ions eluting from tinplate often undergo spontaneous oxidation to the trivalent state when the surface treatment process employs the surface treatment bath on a continuous basis. With the objective of maintaining the iron ions in the divalent state, the use of the oxidation-reduction potential to monitor the oxidation state of the iron ions was therefore examined. As a result, with respect to the treatment of tinplate surfaces by contacting tinplate with an acidic surface treatment bath that contains at least phosphate ion, chelating agent, and tin ion, a method for treating tinplate surfaces was discovered whose characteristic features are a pH in the surface treatment bath in the range of 2.0 to 4.5 and control of the oxidation-reduction potential of the surface treatment bath to $\leqq$ 450 mV by the addition of reducing agent on an as-required basis. The present invention was also achieved based on this discovery. The structure of the present invention is explained in detail below.

DESCRIPTION OF PREFERRED EMBODIMENTS

Phosphoric acid ($H_3PO_4$), sodium phosphate ($Na_3PO_4$), and the like can be used to provide the phosphate ion, and this component should be used in quantities sufficient to bring about tin phosphate precipitation. The reactivity is low when phosphate ion is present at less than 1 g/L, and this prevents satisfactory formation of the coating under ordinary treatment conditions. While a good quality coating is formed at values in excess of 30 g/L, the corresponding high cost of the treatment bath becomes economically disadvantageous. Thus, the phosphate ion is present preferably in the range of 1 to 30 g/L and more preferably in the range of 4 to 8 g/L.

The present invention requires that the bath contain chelating agent in a quantity sufficient to bring about a satisfactory etching, selective conversion film formation on exposed iron regions, and a satisfactory tin ion stabilization. Preferred chelating agents that meet these requirements are exemplified by condensed phosphate ions, tartaric acid, oxalic acid, and citric acid. Particularly preferred chelating agents comprise at least one selection from the condensed phosphate ions. This is because the condensed phosphate ions gradually decompose to phosphoric acid and therefore have little to no adverse effect on waste water treatment. The acid or salt can be used to provide condensed phosphate ion. For example, pyrophosphoric acid ($H_4P_2O_7$), sodium pyrophosphate ($Na_4P_2O_7$), and so forth can be used to provide pyrophosphate ion. The etching activity is weak and film formation is unsatisfactory at a chelating agent concentration of less than 0.1 g/L. On the other hand, the etching activity is too strong and the film-formation reactions are inhibited at more than 5 g/L of chelating agent. The chelating agent content therefore preferably falls in the range of 0.1 to 5 g/L and particularly preferably falls in the range of 0.2 to 1.0 g/L.

Since tinplate DI can has been subjected to DI processing, its surface presents both tin-plated regions and iron regions that have been exposed by the processing, and the corrosion resistance is generally poor when large areas of iron are exposed. For this reason, the generation of uniform coverage of the exposed iron regions by the conversion coating is a crucial issue from the standpoint of improving the corrosion resistance. Because the surface treatment bath of the present invention contains a chelating agent, it is able to selectively and uniformly cover the exposed iron regions with a conversion coating, whereas a very poor conversion is produced at these exposed iron regions in the absence of chelating agent. This makes possible the production of a highly corrosion-resistant conversion film. Moreover, the chelating agent and particularly the condensed phosphates function to stabilize the eluted tin ions in the bath and therefore also act to inhibit sludge production.

The tin ions can be supplied by tin metal or a tin salt, for example, tin chloride, but the tin source is not specifically restricted. In the case of continuous treatment, supplemental additions are not specifically required due to elution of tin ion from the tinplate. The tin ion content should be selected so as to yield the formation of a satisfactory tin phosphate coating, and preferably falls into the range of 0.01 to 2.0 g/L, more preferably into the range of 0.1 to 1.0 g/L, and particularly preferably into the range of 0.2 to 0.6 g/L. The range of 0.01 to 2.0 g/L yields a highly corrosion resistant film and avoids the precipitation of sludge.

The pH of the treatment bath should be maintained at 2.0 to 4.5. Strong etching and an inhibition of film formation are obtained at below 2.0. The anodic reaction conditions suffer from substantial deterioration when the pH exceeds 4.5 because the development of the anodic reactions is inhibited due to the essential absence of oxidizing agent from the treatment bath in accordance with the present invention. Accordingly, the pH must be held in the range of 2.0 to 4.5, and is preferably held in the range of 2.5 to 3.5 and more preferably in the range of 2.7 to 3.3. The pH may be adjusted through the use of an acid such as phosphoric acid, sulfuric acid, and the like or through the use of an alkali such as sodium hydroxide, sodium carbonate, ammonium hydroxide, and the like.

A characteristic feature of the treatment bath in accordance with the present invention is that essentially it contains neither ferric iron ions nor any oxidizing agent that will oxidize any substantial amount of ferrous iron ions to ferric iron ions. Preferably, the concentration of ferric ions in any surface treatment bath according to this invention is not greater than 7 mg/L, more preferably not greater than 3 mg/L, still more preferably not greater than 2.0 mg/L, or most preferably not greater than 1.1 mg/L.

Although prior surface treatment baths have contained oxidizing agent, the surface treatment bath in accordance with the present invention essentially does not contain an oxidizing agent such as oxyacid ion or the like, that is, does not contain oxidizing agent which substantially removes the hydrogen produced by anodic reactions. Given that trivalent iron ion facilitates the occurrence of sludge precipitation, the reason for omitting the oxidizing agent is that the presence of oxidizing agent leads to a condition in which both divalent and trivalent iron ions are present.

The absence of oxidizing agent from tinplate surface treatment baths has heretofore resulted in Unstable conversion characteristics and in particular in an inability to obtain a uniform conversion at exposed iron regions, and for these reasons the absence of oxidizing agent has heretofore been considered undesirable. However, the continuous execution of conversion while still maintaining a good quality conversion film is made possible even in the absence of oxidizing agent by holding the pH and chelating agent concentration within the ranges specified above.

Another crucial point in the treatment process in accordance with the present invention is that the oxidation-reduction potential of the treatment bath is to be controlled to $\leqq$ 450 mV during treatment. No specific restrictions apply to the electrodes used to measure the oxidation-reduction potential. The potentials provided in the present invention were obtained using a platinum electrode as the oxidation-reduction electrode and a silver-saturated silver chloride electrode as the reference electrode. When the oxidation-reduction potential is $\leqq$ 450 mV during this measurement, the iron ion is present almost entirely in the divalent state and the production of sludge is inhibited.

In addition to deliberately added oxidizing agent, atmospheric oxygen also can oxidize the divalent iron ions in the treatment bath. The tendency for the divalent iron ions to be oxidized by atmospheric oxygen varies as a function of the precise nature of the equipment, the spray conditions, and the like. The oxidation-reduction potential may in some cases exceed 450 mV when the present invention is implemented on a continuous basis under conditions in which air tends to be taken up and the difficult-to-avoid removal of bath by the treatment substrate requires only minor renewal of the surface treatment bath. Because sludge will be produced under such circumstances and quality and equipment maintenance will then again become problematic, reducing agent must be added on a preliminary basis or when the oxidation-reduction potential becomes elevated in order thereby to maintain the oxidation-reduction potential at $\leqq$ 450 mV. No specific restrictions apply to this reducing agent, but substances that inhibit conversion film formation on the tinplate by the surface treatment bath should be avoided. Viewed from this perspective, phosphorous acid and hypophosphorous acid are preferred as reducing agents, because the main component of the surface treatment bath is phosphate ion and both phosphorous acid and hypophosphorous acid are converted into phosphate ion in fulfilling their function as reducing agent. Thus, adverse effects due to an accumulation of their decomposition product are completely avoided.

Phosphorous acid and hypophosphorous acid can be added as the acid or salt. The quantity of addition will vary as a function of the treatment conditions, but is preferably as small as possible from the standpoint of economics. Thus, the presence or addition of the minimum quantity that maintains the oxidation-reduction potential at ≦ 450 mV is sufficient. In other words, the quantity of addition of the reducing agent can be regulated based on the oxidation-reduction potential. When the reducing agent is supplied so as to maintain the oxidation-reduction potential at ≦ 450 mV, substantially all of the iron ions in the composition are maintained in the divalent state and the production of sludge in the surface treatment bath can be prevented even during continuous treatment over long periods of time.

The conversion film that is formed will now be briefly considered. The conversion film that is formed by a phosphate surface treatment bath for tinplate is generally a phosphate salt whose principal component is tin phosphate, and the basic mechanism for its formation is believed to be the same even for the present invention. Thus, the tinplate substrate is etched by the phosphate ions and chelating agent (particularly condensed phosphate ions); a local increase in the pH at the interface occurs at this time; and a phosphate conversion film (principally of tin phosphate) precipitates on the surface.

One difference between prior phosphate films and the phosphate film of the present invention is the fact that the prior films are produced in the presence of chelating agent and oxidizing agent while in the present invention production occurs in the presence of chelating agent and (optionally) reducing agent, i.e., the iron ions are only in the divalent state and production occurs essentially in the absence of trivalent ferric ions. A second difference is that the "sludge skin" is then presumably negligible for the film of the present invention. "Sludge skin" refers to the adhesion of a relatively poorly adherent, sediment-like substance in the vicinity of the tin phosphate film proper. Moreover, because the phosphate film formed on tin-plated steel sheet in the case of tinplate DI can is usually extremely thin, approximately 10 to 20 Ångstroms, in both the tin-plated regions and the exposed iron regions, the sludge skin is not susceptible in this case to visual evaluation, in contrast to ordinary zinc phosphate films, for which the areal density is approximately 1 to 10 g/m$^2$ and the corresponding thickness from 1,000 to 8,000 Ångstroms. The exact situation has therefore yet to be elucidated.

The treatment of tinplate using the surface treatment bath of the present invention is briefly explained below. The treatment bath of the present invention is used, preferably as part of the following sequence, which is provided as a preferred example:

Tinplate cleaning: degreasing (a weakly alkaline degreaser is typically used)

Water wash

Surface treatment (application of treatment bath of the present invention)

Treatment temperature: 30° C. to 70° C.

Treatment technique: spray or immersion

Treatment time: 2 to 40 seconds

Water wash

Wash with de-ionized water

Drying.

The treatment temperature with the surface treatment bath of the present invention is preferably 30° C. to 70° C., and heating the bath generally to 40° C. to 60° C. for use is particularly preferred. The preferred treatment time is 2 to 40 seconds. At below 2 seconds, the reaction is inadequate and a highly corrosion-resistant film will not normally be formed. On the other hand, the performance does not improve at treatment times in excess of 40 seconds, and therefore optimal treatment times fall in the range of 2 to 40 seconds.

While the treatment technique can be either immersion or spray, as discussed above the present invention gives particularly good effects when used with spray equipment.

As discussed hereinbefore, the oxidation state of the iron ions that have eluted from the tinplate significantly affects sludge production. Iron ions are believed to elute from the tinplate as divalent ferrous ions. In the treatment bath in accordance with the present invention, the iron ions are typically present as ferrous ions at a concentration of about 0.005 to about 0.025 g/L when the line is running, while ferric ions are essentially not present. In contrast to this, the ferrous ions are almost entirely oxidized in prior art treatment baths to yield ferric ions or colloid in a concentration typically on the level of 0.05 g/L. Sludge is produced because this ferric ion and the phosphate ion form an insoluble salt that also traps the tin and phosphate ions that are present. In other words, sludge production in the surface treatment bath can be suppressed by maintaining the iron ion eluted from the tinplate in the divalent state.

By essentially omitting the oxidizing agent that has been used in prior-art treatment baths, the iron ions in the present invention consist almost completely of divalent iron ions. It is thought that this occurs because both divalent tin ions and tetravalent tin ions are present and the divalent tin ions rapidly reduce trivalent iron ions to divalent iron ions.

The oxidation-reduction potential of a composition is measured by the equilibrium electrode potential of an inert oxidation-reduction electrode in contact with the composition, and it represents the magnitude of the oxidizing power or reducing power of the composition. The following equation gives the oxidation-reduction potential $E_e$ for the half-reaction oxidation of ferrous ion to ferric ion according to the chemical equation $Fe^{2+} \rightarrow Fe^{3+} + e^-$.

$$E_e = E_o - (RT/\mathcal{F}) \ln([Fe^{+2}]/[Fe^{+3}]),$$

where R= the gas constant, T= the absolute temperature, $\mathcal{F}$= Faraday's constant, square brackets indicate activities of the chemical species within the brackets, and $E_o$= the standard electrode potential for the reaction. Larger values of $E_e$ correspond to a higher oxidizing power and thus to a higher ferric ion/ferrous ion ratio; smaller values of the oxidation-reduction potential indicate fewer ferric ions. Accordingly, the average oxidation state of the eluted iron ions can be controlled by controlling the oxidation-reduction potential.

EXAMPLES

The utility of the surface treatment bath of the present invention is explained below through a comparison of several working examples with comparison examples. In these examples, the tinplate substrates consisted of tinplate DI cans fabricated by the DI processing of tin-plated steel sheet. The corrosion resistance after surface treatment was evaluated using the iron exposure value ("IEV"). The IEV was measured in accordance with U.S. Pat. No. 4,332,646. Lower IEV values correspond to a better corrosion resistance, and values ≦ 150 generally correspond to an excellent corrosion resistance.

The paint adherence was evaluated through the peel strength. An epoxy/urea can paint was coated on the surface of the treated can to a paint film thickness of 5 to 7 micrometers ("μM") followed by baking for 4 minutes at 215° C. Each can was subsequently cut into 5×150 mm strips, and a test specimen was prepared by hot pressing polyamide film onto a strip. The test specimen was then peeled in a 180° peel test and the peel strength was measured. In this case, larger peel strength values indicate a better paint adherence, and values of 1.5 kilograms force ("kgf")/5 mm-width or more are generally regarded as excellent.

Sludge production was evaluated as follows. 0.05 g/L of iron ions from ferrous chloride was added to the particular surface treatment bath as described in the working or comparison example, the pH was adjusted, the bath was allowed to stand for 1 day, and the status of the bath was then inspected. A bath that was transparent and free of precipitate or the like was judged as essentially free of ferric ion. The oxidation-reduction potential was measured after standing using a platinum electrode as the oxidation-reduction electrode and a silver-saturated silver chloride electrode as the reference electrode.

In order to evaluate sludge production during continuous treatment, a continuous treatment was run using freshly prepared surface treatment bath as reported in the particular example or comparison example. The continuous treatment used 2 liters ("L") of treatment bath, and a 30-second treatment was conducted on a total of 360 cans. The bath quantity and pH were maintained at their initial values through the addition of the particular surface treatment bath and phosphoric acid, respectively. The bath status and oxidation-reduction potential ("ORP") were evaluated after the continuous test.

A bath that was transparent and free of precipitate or the like was judged to be essentially free of ferric ion. In addition, the iron ion concentration in the treatment bath after continuous treatment was measured by atomic absorption. When a precipitate had been produced, analysis was run by dissolving the precipitate by the addition of hydrochloric acid.

EXAMPLE 1

Tinplate DI cans (fabricated by the DI processing of tin-plated steel sheet) were (1) thoroughly cleaned using a hot 1% aqueous solution of a weakly alkaline degreaser (FINECLEANER™ 4488 from Nihon Parkerizing Company, Limited); (2) sprayed for 20 seconds with surface treatment bath 1 heated to 60° C.; (3) washed with tap water; (4) sprayed with deionized water (with a specific resistance ≧ 3 Mohm-cm) for 10 seconds; and (5) dried in a hot-air drying oven for 3 minutes at 180° C. The treated cans were evaluated for corrosion resistance and paint adherence, and surface treatment bath 1 was evaluated for sludge production.

| Surface treatment bath 1 | |
|---|---|
| 75% phosphoric acid ($H_3PO_4$) | 10.0 gL ($PO_4^{3-}$: 7.2 g/L) |
| Sodium pyrophosphate ($Na_4P_2O_7.10H_2O$) | 1.0 g/L ($P_2O_7^{4-}$: 0.4 gL) |
| $SnCl_4.5H_2O$ | 0.6 g/L ($Sn^{3+}$: 0.2 g/L) |
| $FeCl_3.6H_2O$ | 4.8 mg/L ($Fe^{3+}$: 1.0 mg/L) |
| Phosphorous acid ($H_3PO_3$) | 0.01 g/L |
| pH 3.0 (adjusted with sodium carbonate) | |

The ferric chloride was added in order to examine the effect of trivalent iron ion on sludge production.

EXAMPLE 2

Tinplate DI can was cleaned using the same conditions as in Example 1, sprayed for 10 seconds with surface treatment bath 2 heated to 40° C., and then washed with water and dried under the same conditions as in Example 1. The treated can was evaluated for corrosion resistance and paint adherence, and surface treatment bath 2 was evaluated for sludge production.

| Surface treatment bath 2 | |
|---|---|
| 75% phosphoric acid ($H_3PO_4$) | 5.0 gL ($PO_4^{3-}$: 3.6 g/L) |
| Sodium pyrophosphate ($Na_4P_2O_7.10H_2O$) | 2.0 g/L ($P_2O_7^{4-}$: 0.8 g/L) |
| $SnCl_4.5H_2O$ | 1.2 g/L ($Sn^{4+}$: 0.4 g/L) |
| pH 2.8 (adjusted with phosphoric acid) | |

EXAMPLE 3

Tinplate DI can was cleaned using the same conditions as in Example 1, sprayed for 40 seconds with surface treatment bath 3 heated to 60° C., and then washed with water and dried under the same conditions as in Example 1. The treated can was evaluated for corrosion resistance and paint adherence, and surface treatment bath 3 was evaluated for sludge production.

| Surface treatment bath 3 | |
|---|---|
| 75% Phosphoric acid ($H_3PO_4$) | 5.0 g/L ($PO_4^{3-}$: 3.6 g/L) |
| Sodium pyrophosphate ($Na_4P_2O_7.10H_2O$) | 2.0 g/L ($P_2O_7^{4-}$: 0.8 g/L) |
| $SnCl_4.5H_2O$ | 0.10 g/L ($Sn^{4+}$: 0.03 g/L) |
| Hypophosphorous acid ($H_3PO_2$) | 0.01 g/L |
| pH 4.0 (adjusted with sodium hydroxide) | |

EXAMPLE 4

Tinplate DI can was cleaned using the same conditions as in Example 1, sprayed for 10 seconds with surface treatment bath 4 heated to 40° C., and then washed with water and dried under the same conditions as in Example 1. The treated can was evaluated for corrosion resistance and paint adherence, and surface treatment bath 4 was evaluated for sludge production.

| Surface treatment bath 4 | |
|---|---|
| 75% Phosphoric acid ($H_3PO_4$) | 15.0 g/L ($PO_4^{3-}$: 10.8 g/L) |
| Sodium pyrophosphate ($Na_4P_2O_7.10H_2O$) | 2.0 g/L ($P_2O_7^{4-}$: 0.8 g/L) |
| Sodium tripolyphosphate ($Na_5P_3O_{10}$) | 1.0 g/L ($P_3O_{10}^{5-}$: 0.6 g/L) |
| $SnCl_4.5H_2O$ | 1.2 g/L ($Sn^{4+}$: 0.4 g/L) |
| Phosphorous acid ($H_3PO_3$) | 0.01 g/L |
| Hypophosphorous acid ($H_3PO_2$) | 0.01 g/L |
| pH 3.0 (adjusted with sodium carbonate) | |

EXAMPLE 5

Tinplate DI can was cleaned using the same conditions as in Example 1, sprayed for 30 seconds with surface treatment bath 5 heated to 50° C., and then washed with water and dried under the same conditions as in Example 1. The treated can was evaluated for corrosion resistance and paint adherence, and surface treatment bath 5 was evaluated for sludge production.

| Surface treatment bath 5 | |
|---|---|
| 75% Phosphoric acid ($H_3PO_4$) | 1.0 g/L ($PO_4^{3-}$: 0.7 g/L) |
| Sodium pyrophosphate ($Na_4P_2O_7.10H_2O$) | 2.0 g/L ($P_2O_7^{4-}$: 0.8 g/L) |
| $SnCl_4.5H_2O$ | 1.2 g/L ($Sn^{4+}$: 0.4 g/L) |
| Phosphorous acid ($H_3PO_3$) | 0.01 g/L ($H_3PO_3$: 0.01 g/L) |
| pH 3.0 (adjusted with phosphoric acid) | |

EXAMPLE 6

Tinplate DI can was cleaned using the same conditions as in Example 1, sprayed for 20 seconds with surface treatment bath 6 heated to 50° C., and then washed with water and dried under the same conditions as in Example 1. The treated can was evaluated for corrosion resistance and paint adherence, and surface treatment bath 6 was evaluated for sludge production.

| Surface treatment bath 6 | |
|---|---|
| 75% Phosphoric acid ($H_3PO_4$) | 5.0 g/L ($PO_4^{3-}$: 3.6 g/L) |
| Sodium pyrophosphate ($Na_4P_2O_7.10H_2O$) | 2.0 g/L ($P_2O_7^{4-}$: 0.8 g/L) |
| Tin (by dissolution of tin metal) | 0.2 g/L ($Sn^{2+}$: 0.2 g/L) |
| Phosphorous acid ($H_3PO_3$) | 0.01 g/L ($H_3PO_3$: 0.01 g/L) |
| pH 3.0 (adjusted with phosphoric acid) | |

EXAMPLE 7

Tinplate DI can was cleaned using the same conditions as in Example 1, sprayed for 2 seconds with surface treatment bath 7 heated to 70° C., and then washed with water and dried under the same conditions as in Example 1. The treated can was evaluated for corrosion resistance and paint adherence, and surface treatment bath 7 was evaluated for sludge production.

| Surface treatment bath 7 | |
|---|---|
| 75% Phosphoric acid ($H_3PO_4$) | 30.0 g/L ($PO_4^{3-}$: 21.6 g/L) |
| Sodium pyrophosphate ($Na_4P_2O_7.10H_2O$) | 2.0 g/L ($P_2O_7^{4-}$: 0.8 g/L) |
| Sodium tripolyphosphate ($Na_5P_3O_{10}$) | 1.0 g/L ($P_3O_{10}^{5-}$: 0.6 g/L) |
| $SnCl_4.5H_2O$) | 1.2 g/L ($Sn^{4+}$: 0.4 g/L) |
| Phosphorous acid ($H_3PO_3$) | 0.01 g/L |
| Hypophosphorous acid ($H_3PO_2$) | 0.01 g/L |
| pH 2.0 (adjusted with phosphoric acid) | |

Comparison Example 1

Tinplate DI can was cleaned using the same conditions as in Example 1, sprayed for 30 seconds with surface treatment bath 8 heated to 40° C., and then washed with water and dried under the same conditions as in Example 1. The treated can was evaluated for corrosion resistance and paint adherence, and surface treatment bath 8 was evaluated for sludge production.

| Surface treatment bath 8 | |
|---|---|
| 75% Phosphoric acid ($H_3PO_4$) | 10.0 g/L ($PO_4^{3-}$: 7.2 g/L) |
| $SnCl_4.5H_2O$ | 0.6 g/L ($Sn^{4+}$: 0.2 g/L) |
| Phosphorous acid ($H_3PO_3$) | 0.01 g/L |
| pH 3.0 (adjusted with sodium carbonate) | |

Comparison Example 2

Tinplate DI can was cleaned using the same conditions as in Example 1, sprayed for 30 seconds with surface treatment bath 9 heated to 50° C., and then washed with water and dried under the same conditions as in Example 1. The treated can was evaluated for corrosion resistance and paint adherence, and surface treatment bath 9 was evaluated for sludge production.

| Surface treatment bath 9 | |
|---|---|
| 75% Phosphoric acid ($H_3PO_4$) | 10.0 g/L ($PO_4^{3-}$: 7.2 g/L) |
| Sodium pyrophosphate ($Na_4P_2O_7.10H_2O$) | 1.0 g/L ($P_2O_7^{4-}$: 0.4 g/L) |
| $SnCl_4.5H_2O$ | 0.6 g/L ($Sn^{4+}$: 0.2 g/L) |
| Phosphorous acid ($H_3PO_3$) | 0.01 g/L |
| pH 4.6 (adjusted with sodium hydroxide) | |

Comparison Example 3

Tinplate DI can was cleaned using the same conditions as in Example 1, sprayed for 30 seconds with surface treatment bath 10 heated to 50° C., and then washed with water and dried under the same conditions as in Example 1. The treated can was evaluated for corrosion resistance and paint adherence, and surface treatment bath 10 was evaluated for sludge production.

| Surface treatment bath 10 | |
|---|---|
| 75% Phosphoric acid ($H_3PO_4$) | 1.33 g/L ($PO_4^{3-}$: 0.97 g/L) |
| Sodium pyrophosphate ($Na_4P_2O_7.10H_2O$) | 1.0 g/L ($P_2O_7^{4-}$: 0.4 g/L) |
| $SnCl_4.5H_2O$ | 0.6 g/L ($Sn^{4+}$: 0.2 g/L) |
| $FeCl_3.6H_2O$) | 48 mg/L ($Fe^{3+}$: 10 mg/L) |
| pH 4.0 (adjusted with sodium carbonate) | |

Comparison Example 4

Tinplate DI can was cleaned using the same conditions as in Example 1 and was then sprayed for 30 seconds with a 4% aqueous solution (heated to 50° C.) of a commercial tinplate DI can surface treatment agent (PALFOS™ K3466 from Nihon Parkerizing Company, Limited). This was followed by washing with water and drying under the same conditions as in Example 1. The treated can was evaluated for corrosion resistance and paint adherence, and the treatment bath was evaluated for sludge production.

Comparison Example 5

Tinplate DI can was cleaned using the same conditions as in Example 1 and was then sprayed for 30 seconds with a 4% aqueous solution (heated to 50° C.) of a commercial tinplate DI can surface treatment agent (PALFOS™ K3482 from Nihon Parkerizing Company, Limited). This was followed by washing with water and drying under the same conditions as in Example 1. The treated can was evaluated for corrosion resistance and paint adherence, and the treatment bath was evaluated for sludge production.

The results are reported in Table 1.

Benefits of the Invention

As discussed in the preceding, treating the surface of tinplate (tin-plated steel) sheet, strip, or shaped objects (cans or the like) with the surface treatment bath of the present invention accrues the highly desirable effects of imparting an excellent corrosion resistance and adherence to the tinplate surface and avoiding sludge production in the treatment bath when treatment is run on a continuous basis.

TABLE 1

| Example ("E") or Comparison Example ("CE") Number | Conversion Film Quality: Corrosion Resistance (IEV Value) | Conversion Film Quality: Adhesion, kgf/5 mm | Sludge Production Results: With Direct Addition of Iron: Bath Appearance | With Direct Addition of Iron: ORP, mV | After Continuous Use for Treatment: Bath Appearance | After Continuous Use for Treatment: ORP, mV | After Continuous Use for Treatment: Iron, ppm |
|---|---|---|---|---|---|---|---|
| E 1 | 100 | 3.0 | Transparent | 370 | Transparent | 170 | 18 |
| E 2 | 100 | 3.0 | Transparent | 430 | Transparent | 260 | 9 |
| E 3 | 120 | 2.5 | Transparent | 420 | Transparent | 210 | 10 |
| E 4 | 100 | 3.0 | Transparent | 400 | Transparent | 200 | 8 |
| E 5 | 100 | 3.0 | Transparent | 390 | Transparent | 200 | 12 |
| E 6 | 100 | 3.0 | Transparent | 400 | Transparent | 210 | 18 |
| E 7 | 150 | 2.0 | Transparent | 430 | Transparent | 230 | 25 |
| CE 1 | 500 | 1.5 | Tur. W. Ppt. | 450 | Tur. W. Ppt. | 650 | 80 |
| CE 2 | 300 | 1.5 | Transparent | 400 | Transparent | 350 | 8 |
| CE 3 | 300 | 1.5 | W. Turbidity | 550 | Tur. W. Ppt. | 650 | 30 |
| CE 4 | 100 | 3.0 | Tur. W. Ppt. | 700 | Tur. W. Ppt. | 700 | 60 |
| CE 5 | 100 | 3.0 | Tur. W. Ppt. | 700 | Tur. W. Ppt. | 700 | 25 |

Notes for Table 1
"ORP" means "oxidation-reduction potential", which was measured against a silver-saturated silve chloride reference electrode; "IEV" means: "iron exposure value", as described in the main text; "Tur. W. Ppt." means "Turbid White Precipitate"; "W. Turbid." means "white turbidity".

The invention claimed is:

1. An aqueous liquid composition suitable for treating tinplate surfaces, said composition having a pH in the range from 2.0 to 4.5 and an oxidation- reduction potential not greater than 450 mV more oxidizing than a silver-saturated silver chloride reference electrode, and consisting essentially of water and:

(A) from 1 to 30 g/L of phosphate ions, (B) from 0.1 to 5.0 g/L of chelating agent, and (C) from 0.01 to 2.0 g/L of tin ions.

2. A composition according to claim 1, wherein the chelating agent is selected from condensed phosphate ions.

3. A composition according to claim 2, wherein the concentration of tin ions is from 0.1 to 1.0 g/L and the pH is from 2.5 to 3.5.

4. A composition according to claim 3, wherein the concentration of tin ions is from 0.2 to 0.6 g/L and the pH is from 2.7 to 3.3.

5. A composition according to claim 1, wherein the concentration of tin ions is from 0.1 to 1.0 g/L and the pH is from 2.5 to 3.5.

6. A composition according to claim 5, wherein the concentration of tin ions is from 0.2 to 0.6 g/L and the pH is from 2.7 to 3.3.

7. A composition according to claim 6, wherein the concentration of phosphate ions is within the range from 4 to 8 g/L and the concentration of chelating agent is within the range from 0.2 to 1.0 g/L.

8. A composition according to claim 5, wherein the concentration of phosphate ions is within the range from 4 to 8 g/L and the concentration of chelating agent is within the range from 0.2 to 1.0 g/L.

9. A composition according to claim 4, wherein the concentration of phosphate ions is within the range from 4 to 8 g/L and the concentration of chelating agent is within the range from 0.2 to 1.0 g/L.

10. A composition according to claim 3, wherein the concentration of phosphate ions is within the range from 4 to 8 g/L and the concentration of chelating agent is within the range from 0.2 to 1.0 g/L.

11. A composition according to claim 2, wherein the concentration of phosphate ions is within the range from 4 to 8 g/L and the concentration of chelating agent is within the range from 0.2 to 1.0 g/L.

12. A composition according to claim 1, wherein the concentration of phosphate ions is within the range from 4 to 8 g/L and the concentration of chelating agent is within the range from 0.2 to 1.0 g/L.

13. A process for treating tinplate to form a protective coating thereon, comprising contacting the tinplate with a composition according to claim 12 at a temperature within the range from 30° to 70° C. for a time within the range from 2 to 40 seconds.

14. A process according to claim 13, wherein a reducing agent is added to the initial composition as the latter is used, in an amount sufficient to maintain the oxidation-reduction potential of the composition not more than 450 mV more oxidizing than a silver-saturated silver chloride reference electrode.

15. A process according to claim 14, wherein the reducing agent is selected from the group consisting of phosphorous acid, hypophosphorous acid, their salts, and mixtures of any two or more of said acids and their salts.

16. A process for treating tinplate to form a protective coating thereon, comprising contacting the tinplate with a composition according to claim 7 at a temperature within the range from 40° to 60° C. for a time within the range from 2 to 40 seconds.

17. A process according to claim 16, wherein a reducing agent is added to the initial composition as the latter is used, in an amount sufficient to maintain the oxidation-reduction potential of the composition not more than 450 mV more oxidizing than a silver-saturated silver chloride reference electrode.

18. A process according to claim 17, wherein the reducing agent is selected from the group consisting of phosphorous acid, hypophosphorous acid, their salts, and mixtures of any two or more of said acids and their salts.

19. A process for treating tinplate to form a protective coating thereon, comprising contacting the tinplate with a composition according to claim 1 at a temperature within the range from 30° to 70° C. for a time within the range from 2 to 40 seconds.

20. A process according to claim 19, wherein a reducing agent is added to the initial composition as the latter is used, in an amount sufficient to maintain the oxidation-reduction potential of the composition not more than 450 mV more oxidizing than a silver-saturated silver chloride reference electrode.

* * * * *

UNITED STATES PATENT AND TRADEMARK OFFICE

CERTIFICATE OF CORRECTION

PATENT NO. : 5,498,300

DATED : Mar. 12, 1996

INVENTOR(S) : Tomoyuki Aoki, Masayuki Yoshida

It is certified that error appears in the above-indentified patent and that said Letters Patent is hereby corrected as shown below:

In col. 7, Surface treatment bath 1 table, rows 1 & 2, delete [gL] and insert --g/L--, two occurrences.

In col. 8, Surface treatment bath 2 table, row 1, delete [gL] and insert --g/L--.

Signed and Sealed this

Seventeenth Day of September, 1996

*Attest:*

Bruce Lehman

BRUCE LEHMAN

*Attesting Officer*

*Commissioner of Patents and Trademarks*